US005324028A

United States Patent [19]

Luna

[11] Patent Number: 5,324,028

[45] Date of Patent: Jun. 28, 1994

[54] INTELLIGENT GOLF PARTIES GUIDANCE SYSTEM

[76] Inventor: Luis A. Luna, Calle 7, Quinta Haydee, Colinas de Vista Alegre, Caracas 1020, Venezuela

[21] Appl. No.: 965,321

[22] Filed: Oct. 23, 1992

[51] Int. Cl.[5] ..... A63B 57/00

[52] U.S. Cl. ..... 273/32 R; 273/32 H; 273/176 A; 273/176 L; 340/323 R; 364/410

[58] Field of Search ..... 273/32 H, 32 B, 32 R, 273/176 L, 176 A; 340/323 R; 364/410

[56] References Cited

U.S. PATENT DOCUMENTS

| | | | |
|---|---|---|---|
| 3,868,692 | 2/1975 | Woodard et al. | 273/32 H |
| 4,703,444 | 10/1987 | Storms, Jr. et al. | 364/561 |
| 5,044,634 | 9/1991 | Dudley | 273/22 R |
| 5,046,839 | 10/1991 | Krangle | 356/5 |
| 5,056,106 | 10/1991 | Wang et al. | 375/1 |
| 5,086,390 | 2/1992 | Matthews | 364/410 |
| 5,095,430 | 3/1992 | Bonito et al. | 369/10 |
| 5,097,416 | 3/1992 | Matthews | 364/410 |
| 5,216,641 | 6/1993 | Hoel | 368/10 |

FOREIGN PATENT DOCUMENTS 9204080 3/1992 PCT Int'l Appl. ..... 273/32 H

*Primary Examiner*—Vincent Millin
*Assistant Examiner*—Kerry Owens
*Attorney, Agent, or Firm*—Keck, Mahin & Cate

[57] ABSTRACT

A computer based system for guiding golfers around a golf course enables the holes to be played in an order designated by the system according to the situation on the golf course when the players are ready to start playing a now hole. The holes are not necessarily played in the traditional numerical sequence. A player inserts a card into a port on a golf course and is instructed, for example, by instructions received on a video monitor, as to the hole which is most convenient for play to begin for his party. At the end of that hole, the card is inserted into a terminal adjacent to the green on which play has been completed, and instructions are provided as to the next hole to be played. The players in the party proceed to the designated tee, as instructed, and play the hole. The process is repeated to find the next hole to play, etc. The computer system keeps a record of holes played, so that each hole is played only once by the party. The system eliminates problems caused by different speeds of play by different parties.

28 Claims, 17 Drawing Sheets

INTELLIGENT GOLF PARTIES GUIDANCE SYSTEM

FIELD OF THE INVENTION

The invention relates to a method of guiding parties of golfers around a golf course.

BACKGROUND OF THE INVENTION

It is a waste of time for many golfers to wait for slower golfers on the golf course to vacate a hole in order for the waiting golfers to be able to continue play. This occurs, for example, when groups on a golf course are heterogeneous in the number of players, their relative skill and other characteristics which affect skill. This situation is contrary to an ideal shared by all golfers, that golf matches should be composed of the same number of players, and that they play at the same speed so that each of the holes can be played in the same amount of time enabling the numerical sequence defined by the course to be followed. Unfortunately, this is the exception rather than the rule because on any golf course the golf groups are often heterogeneous in the number of players, their skill and/or other characteristics. Because of the heterogeneity, it is impossible for the groups to play at the same speed. Therefore, play is delayed.

Players may choose to resolve the problem of slower players is ultimately the decision of the players to pass or be passed or to skip holes occupied by slower players which can culminate in conflicts between groups since there is no automatic or organized way to solve the problem. Such problems take away from the fundamental goal of golf, namely to spend a few hours outdoors while playing the sport the best that one can.

The problem, which is caused by unequal speed of play, occurs on courses of all sizes. Even on a large course, with only two golf parties, the problem still exists. Sooner or later, the faster group will catch up with the slower group. The faster group will continue to play behind the slower one or ask for permission to pass. The group that is ahead makes the decision as to whether or not the following group can pass, which causes displeasure or approval of the former and makes the latter uneasy. The faster group may then choose to skip that hole and come back to it later when they have the opportunity.

As the number of groups increases, the problem becomes more acute and the number of situations, like those described above, increase. This produces chaos and displeasure among the players. If the numerical order of the holes is always adhered to, all of the groups are forced to play at the pace of the slower groups.

On some courses, usually the public courses, the management tries to homogenize the matches as much as possible by making all the groups equal in number. This may produce groups which are not harmonious and may be unpleasant for the players. This method, however, does not guarantee that the groups play at the same pace, nor that the problem sought to be corrected does not arise.

It is clear that a problem exists because of the variance in speed of each group that plays on a given course. This problem has been a part of golf for most of its existence, and despite its negative effects it is considered to be a natural consequence of playing golf.

Remedio et al., U.S. Pat. No. 4,910,677, describes a golf score recording system and network. The system provides automated score keeping operated from a golf cart or other mobile unit. Several golf courses may be connected into one system and player profiles may be generated and retrieved. There is no disclosure of a system for playing holes in a variable order.

The patent to Dudley, U.S. Pat. No. 5,044,634, describes a golf information system which automatically provides golfers with golf course location information including yardage from several locations to the nearest green. The informational tags recognized by the computer may be buried in the ground along paths traveled by a golf cart or in other non-obtrusive positions. The system could also carry information concerning speed of play and other messages, such as advertising messages.

The two patents to Matthews, U.S. Pat. Nos. 5,086,390 and 5,097,416, describe systems for monitoring play of golfers. U.S. Patent No. 5,086,390 describes a system for monitoring the speed of play of golfers for purposes of utilization of golf carts and golf holes and also for warning players who are habitually slow that their rate of play should be increased to avoid disruption to others. A mobile transmitter is described which sends location signals responsive to the position of a golfer. The signals may be received by a mobile receiver. U.S. Pat. No. 5,097,416 describes a related system in which a player is alerted when play at a hole has exceeded the designated time for playing that hole. The location of the player is monitored and means are described for determining the length of actual elapsed time for each hole compared with a predetermined playing time for the subject hole.

None of these patents suggest a system for controlling the order in which the holes of a golf course are played according to measured conditions of speed of play and/or convenience according to the situation of the course.

SUMMARY OF THE INVENTION

The system of the invention is a unique system based on a technique that automatically and efficiently manages the parties that are playing on a golf course; the technique employs a logic that does not necessarily follow the numerical sequence of the holes on the golf course. Other objectives can also be met.

The invention is a computer based system for guiding golfers around a golf course. The holes are played in the order designated by the system according to the situation on the golf course when the players are ready to start playing a new hole. A player inserts a card into a terminal on a golf course and is instructed, for example, by instructions received on a video monitor, as to the hole which is the most logical and convenient for play to begin for his group. At the end of that hole, the card is inserted into a terminal adjacent to the green on which play has been completed, and instructions are provided as to the next hole to be played. The players in the group proceed to the designated tee, as instructed, and play the hole. The process is repeated to find the next hole to play, etc. The computer system keeps a record of holes played, so that each hole is played, even if out of normal sequence.

The system also allows players to call in to a central monitor for services required or desired, such as calling for emergency medical services or calling for beverages to be brought.

The techniques, methods, procedures, and technical innovations that characterize the different components of the invention were conceived for the purpose of eliminating the inherent problem in the game of golf that the holes must conventionally be played in a predetermined numerical sequence (from hole 1 through hole 18) which does not take into consideration the speed of play. This produces less than optimum use of the course, preventable delays and, in many cases, displeasure among the players.

The system uses a computer program which contains comprehensive information about the course characteristics and about the golf matches in play. In use, the program automatically allows analysis of the current situation on the golf course as soon as the program is supplied with information of a new party that will be playing. The new players tee off from the hole indicated by the system for beginning the round of golf. The program incorporates and responds to any new situation created on the golf course.

The technological and informational ability guarantees intelligent management of play since problems that arise are solved by means of a constant and rapid flow of information between the golfers, the starter, the grounds staff and the management. This is achieved by strategically placing instruments around the course that transmit directly to the central computer of the system. The system allows discreet organization of play without jeopardizing the pleasure of the game enjoyed by the players.. The system also ensures that the course is fully utilized because the starting of one party is coordinated with the finishing of another party. When there are a great number of players waiting to start on a typical golf course of 18 holes with a par of 72, use of the system allows the start of up to 18 simultaneous parties, while putting into play up to 144 golfers in a time span of 15 minutes if parties tee off every 7 to 8 minutes. Thus, a normal golf course can be played by more than 580 golfers in a 12 hour period.

In managing parties, the system adheres to the traditions of play by applying universally accepted criteria of the game of golf and other criteria dictated by logic, aesthetics, and golf etiquette. The system can also initiate some maintenance tasks without interrupting a golf match. Further, the system has the capability to detect abnormalities in the golfers' play, and call attention to these facts.

The system of the invention offers new benefits to the golfer as well as to the management. To the golfer, it offers play without delay, pressure, and without having to make decisions unrelated to the game. Golfers are able to begin play as soon as arriving at the golf course, and are able to be located anywhere on the course at any given time.

The management may organize multiple starts, simultaneously, from different holes to take advantage of the maximum capabilities of the facilities, while increasing efficiency. Maintenance tasks can be adequately planned. The matches on the golf course are all under complete control of the system. Likewise, a data base can be produced and maintained of all activities that take place on the golf course.

BRIEF DESCRIPTION OF THE DRAWINGS

FIG. 4(*b*) is a plan view of another personal identification Revice.

FIG. 4(*c*) is a plan view of a further personal identification device.

DETAILED DESCRIPTION OF THE PREFERRED EMBODIMENTS

The system described provides a method of guiding people to multiple events under a common organization. The system is designed to increase the efficiency of a golf course and is based on the dynamic and intelligent technology of guiding golf parties, automatically, which permits the system to take total control of the distribution of groups on the course so that these groups may play all of the holes with the least amount of delay and/or inconvenience. To this effect, a system of the invention guides the groups to each of the holes, but not necessarily following their numerical sequence. The management is able to use the golf course efficiently and economically because the system of the invention frequently monitors the groups on the golf course and analyzes changes in the situation caused, for example, by players beginning and ending holes.

The distribution of the groups on the course is designated in an impersonal and automatic fashion. The system is always aware of the details of each golf party and the details of how many people are in each party (twosome, threesome, foursome), the average handicap of each player, of what sex or sexes the groups are comprised, the average age of the party (youth, adult, middle-aged, or elderly), from which hole play began, which holes have been played, which holes are left to play, and other factors of the course.

Figure 1:
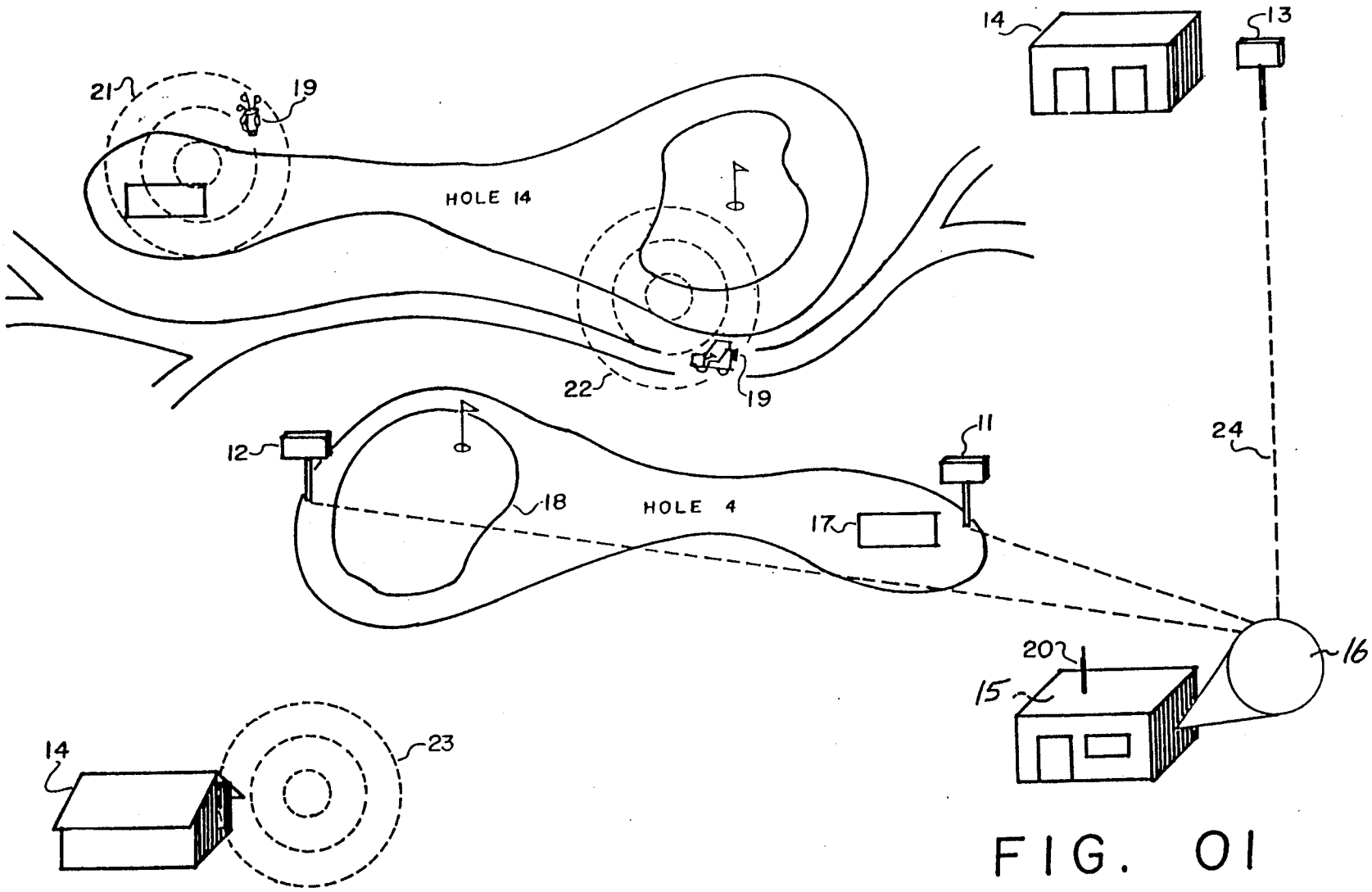
FIG. 1 is a schematic view of part of a golf course showing components of a system of the invention.

FIG. 1 illustrates a golf course in which the components of the Intelligent Golf Parties Guidance System are installed. The tee area port 11, green area port, 12 and service area port 13 are set up for use by players and management adjacent a tee 17, green 18 and service area 14, respectively. The club house or starter's room 15 is shown as is the system central control location 16. A transceiver 19 may be located on a golf cart and/or on a golf bag and communicates with the central transceiver by antenna 20. Electromagnetic fields 21, 22 and 23 are located around the tee off area, putting green area and service area, respectively. The system central control 16 is connected to the ports 11, 12, 13 by communication means 24.

Figure 2:
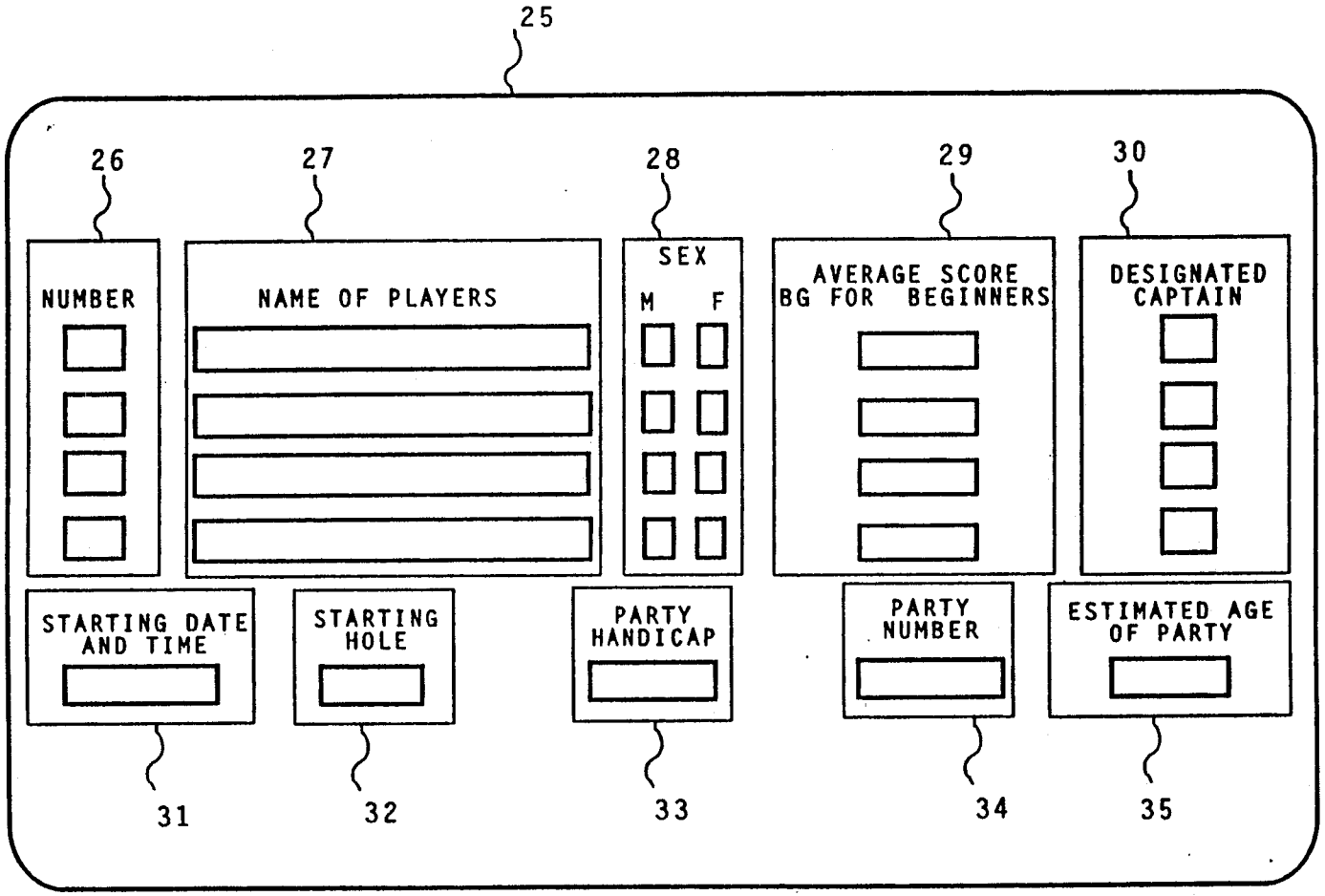
FIG. 2 is a schematic view of an input screen for entering data concerning a party of golfers.

FIG. 2 shows the how the data of a golf match appears on screen 25 of the center of operations of the system. The number of players in a match 26, their names 27, sex 28, average score 29, and the designated team captain 30. The captain, who is responsible for the group, can be chosen by the criteria of choice by the management, for example, the best player in the group, the only club member, the oldest, etc.

Other data shown in FIG. 2, such as starting date and time 31, starting hole 32, party handicap 33 and party number 34, are respectively calculated and/or generated by the system. The estimated age of the party 35 (young, adult, middle-aged or elderly) may be supplied by the party or estimated by the starter. The system forecasts play according to these characteristics and also "learns" certain aspects of a group's characteristics according to the play on the course. The system is intelligent and updates itself by its own observations.

The system contains all of the necessary characteristics of the golf course, such as the distribution of the holes, the network of intercommunication, the topography of the landscape, the location of different services, the handicap of each hole, and the "delay factor" of the hole.

The delay factor is a new concept in the world of golf. It refers to factors, apart from the handicap of the hole, that can produce delays in the game, such as searching for a lost ball in high grass or in water hazards, temporary or permanent restrictions in certain areas, and any other fixed or circumstantial characteristics of the hole.

Figure 3:
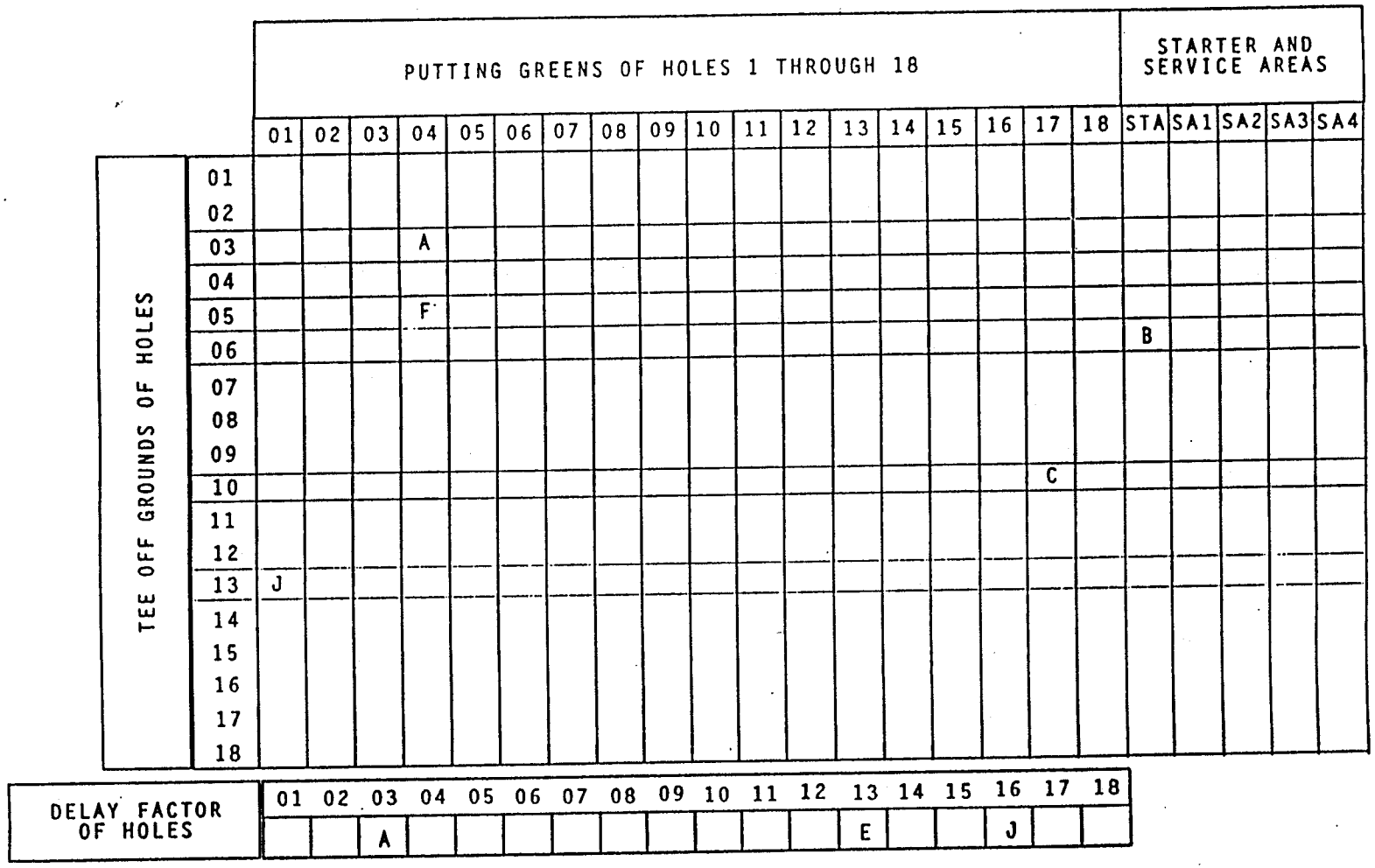
FIG. 3 is a schematic view of a typical format specifying the important characteristics of a golf course.

FIG. 3 illustrates how relevant information about the tees and putting greens of holes 1 to 18, the starter area and service areas SA1, SA2, SA3, and SA4, and the delay factor of each hole are represented on a typical course. The overall accessibility is graded from "A" to "J", "A" being the easiest, "J" being the hardest, the accessibility being measured by distance and other factors that indicate the proximity of a green, a service area or a starter to any tee area. The delay factor is also represented by the letters "A" to "J", "A" being the lowest delay factor and "J" the highest. For example, the delay factor on hole 3 is "A" (very low). Hole 13 has a delay factor of "E" (moderate) and hole 16 has a delay factor of "J" (very high). It is also illustrated that the accessibility from hole 4 to hole 3 is "A" (very easy), from hole 4 to hole 5 is "F" (moderate) , from hole 1 to hole 13 is "J" (impractical), from the starter to hole 6 is "B" (fairly easy) and from hole 17 to hole 9 is "C" (easy).

Based on the characteristics of the course and the group, the system can deduce how the normal progress of play of that party is expected to be.

When a system of the invention is newly incorporated into a course, its "knowledge" is limited to the input by the management. Nevertheless, the system is adaptable which allows calculation of changes according to the behavior of groups on the course. This serves to actualize the program, and constantly to seek new information that will improve the administration of the golf course.

A course equipped with a system of the invention allows faster groups to play quickly, though not necessarily in the traditional, numerical order. In many cases, the system will designate that a group starts from a hole other than hole 1. After checking the course, the system will choose the hole most convenient for that particular group to start.

The system allows many groups to tee off, simultaneously, from different holes. This eliminates the need to reserve a "time". In practice, the system enables groups to begin play as soon as they arrive at the course and are ready to start.

On a typical 18-hole golf course with a course rating of 72 handicap, the system can order the start of up to 18 simultaneous parties, with one party starting every 7 to 8 minutes, thus putting up to 144 players into play in about 15 minutes. Thus on a normal golf course it is possible to serve up to 580 golfers in a 12 hour day.

The system offers an intelligent and rational way of playing the game without compromising its charm nor altering its rules, while the course is used to its full potential. The system introduces a subtle technique that permits the players to deviate from the traditional method of play. The system respects the traditions of play to the extent that it is possible. For example, a normal party, which the system defines as a foursome that plays at a moderate speed, may play all of the holes on the course in numerical order. The sequence could begin at the hole 1 and end at hole 18 provided that the distribution of the groups around the course permitted it, or if the foursome is willing to wait for the right moment, which occurs frequently.

The system allows adherence to the universally accepted rules of play, and other rules dictated by logic and etiquette, and even by the aesthetics of the game. For example, the system can be programmed to avoid a group playing two "par 5" holes in a row, or two "par 3" holes in a row. The system also tries to avoid a group starting on hole 18 or ending on hole 1.

The speed of play based on the initial data of the group may be ignored by the system, if so desired by the management. This would allow a twosome, for example, to play at a relatively slow pace. In this case, the system does not hurry the group because the information has been input to the system. However, if the group decides to speed up play they simply inform the system of this request, and it replies by indicating where to proceed.

The system is also capable of effecting certain maintenance tasks, such as watering a hole when it is not in use. The system can also select that a hole will remain unoccupied for a certain period of time.

Abnormal behavior in a group can be detected and brought to the group's attention. For example, if a group plays at a slower speed than corresponds to its characteristics, without having been authorized by the management, the group is automatically informed of this by the system. If the group does not comply with the instructions provided by the system, the system advises the management and a person can go to the site where the problem occurs.

Play on a golf course using the system allows a golfer to play without delays or pressure, and without having to make decisions unrelated to golf, thus allowing the player to enjoy golf to the fullest. The need to reserve a "tee off" time is eliminated and play can begin play as soon as the of golfers arrive at the course. The players can be located anywhere on the course at any given time, eliminating the need for cellular phones, "beepers", or other devices that can interfere with the game.

Among the advantages offered to the management by use of the system are the flexibility to allow multiple groups to tee off simultaneously from different holes, eliminating needless delays as well as the ability to use the resources of the course to the fullest potential in a very short period of time, keeping the players happy. Course maintenance and customer service tasks can also be planned and carried out efficiently. The management can be completely informed of all the developments on the course and can have complete control over such developments at all times.

The management can also, advantageously, compile a database of itemized information of the activities on the course whenever desired or needed. Such information can cover every detail of the course from the date that the system is installed.

To yield the maximum benefits of the system, the course must meet the following guidelines: the mode of transportation must be by self-propelled carts; the course must have signs and directions so that the players may easily orient themselves on the course; and the players must be able to move easily from one hole to another. The course must also have pathways that allow relatively easy access to any of the holes.

Use of the system is not limited to courses that are not equipped with self propelled carts. Courses in which the players move on foot can also install the system. Even though the system would operate under different circumstances, the same objectives of efficient use of the course up to its maximum potential would still be met.

Figure 6:
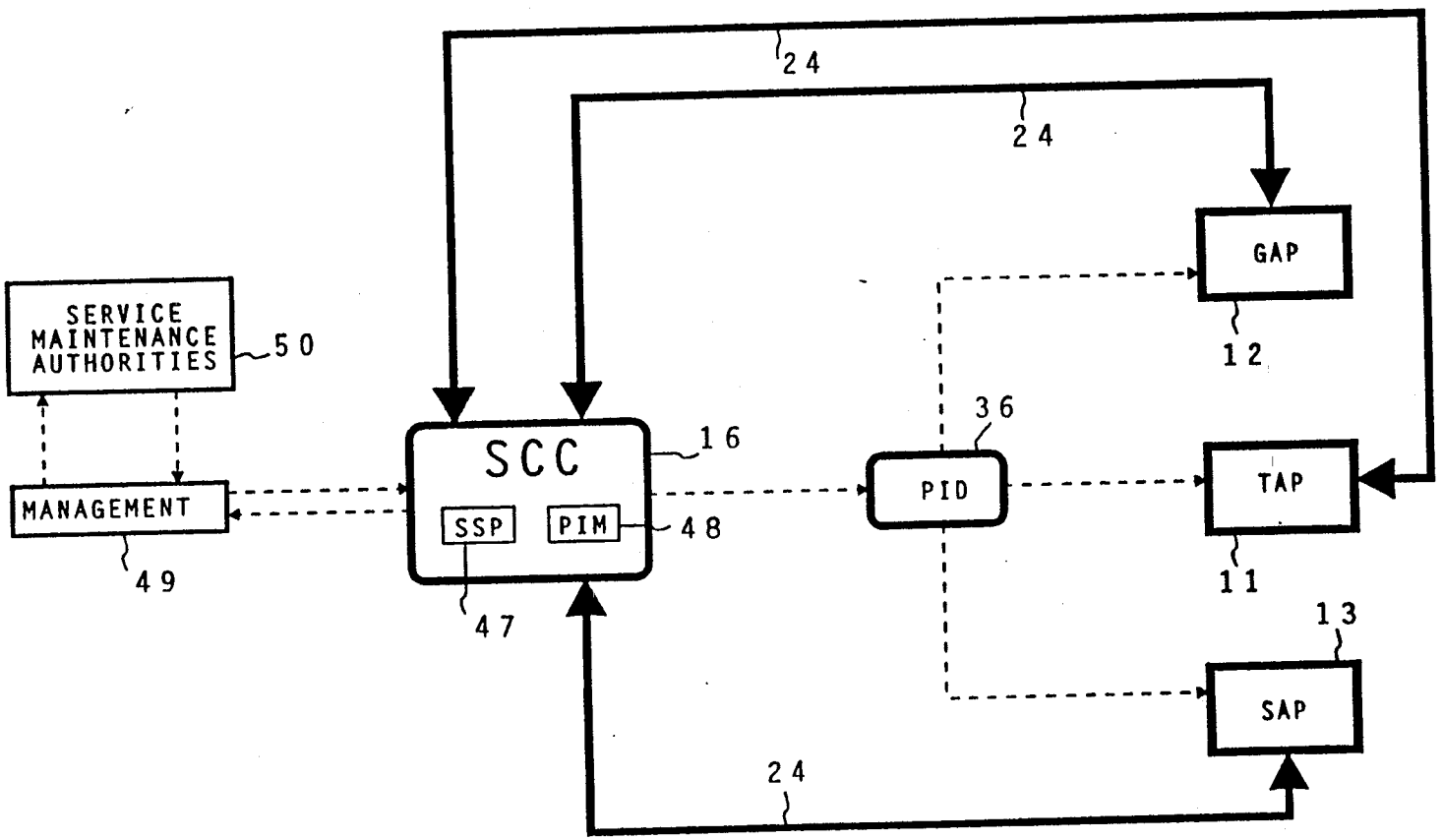
FIG. 6 is a schematic diagram showing the connections between the main components of the system.

FIG. 6 illustrates a packet formed primarily by a software program which is adaptable to any golf course, a series of parts, and hardware all of which are interconnected. These can be modified according to the buyer's requirements and the course characteristics.

Figure 13:
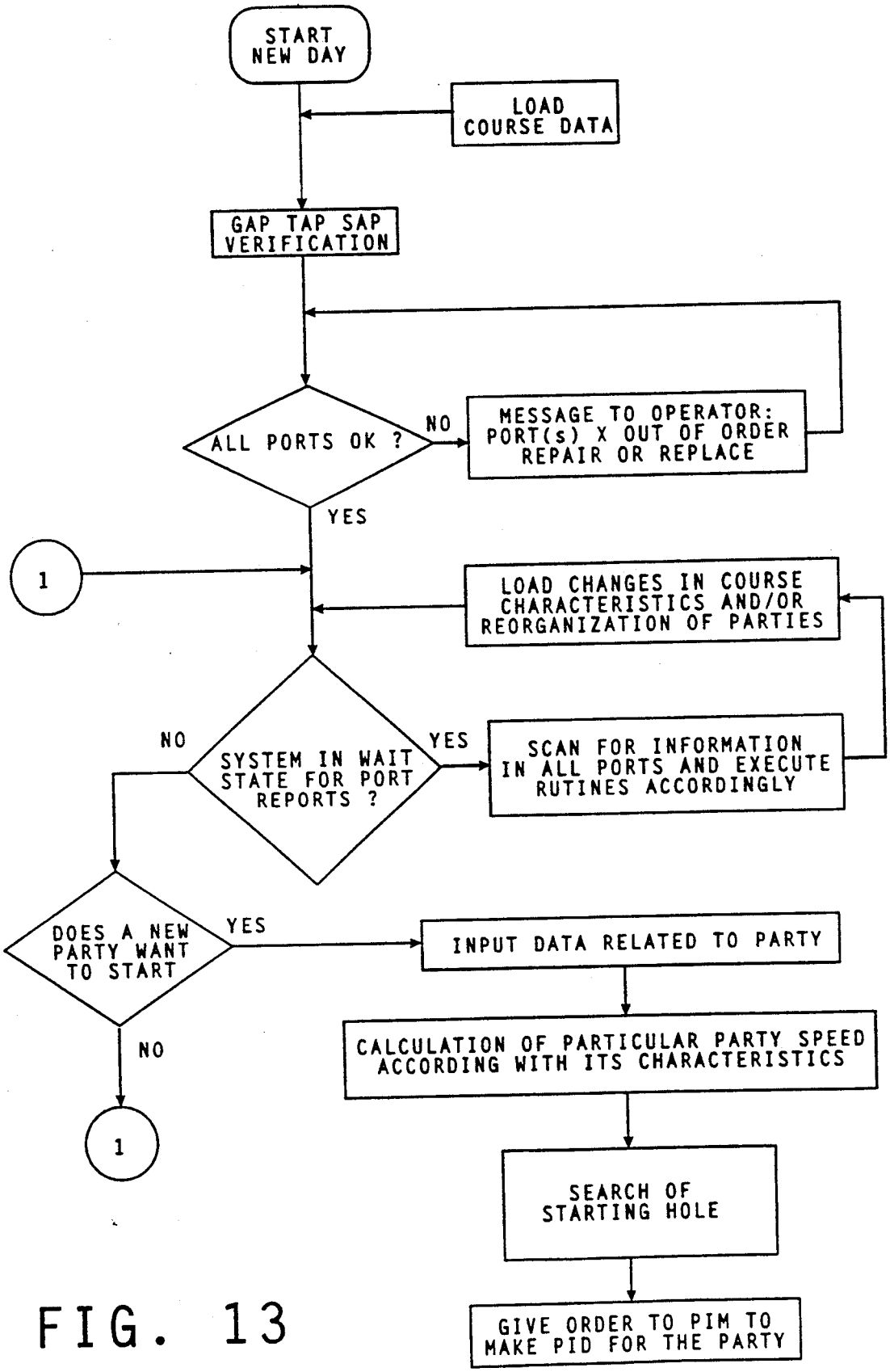
FIG. 13 is a flow diagram for the system software program.
Figure 14:
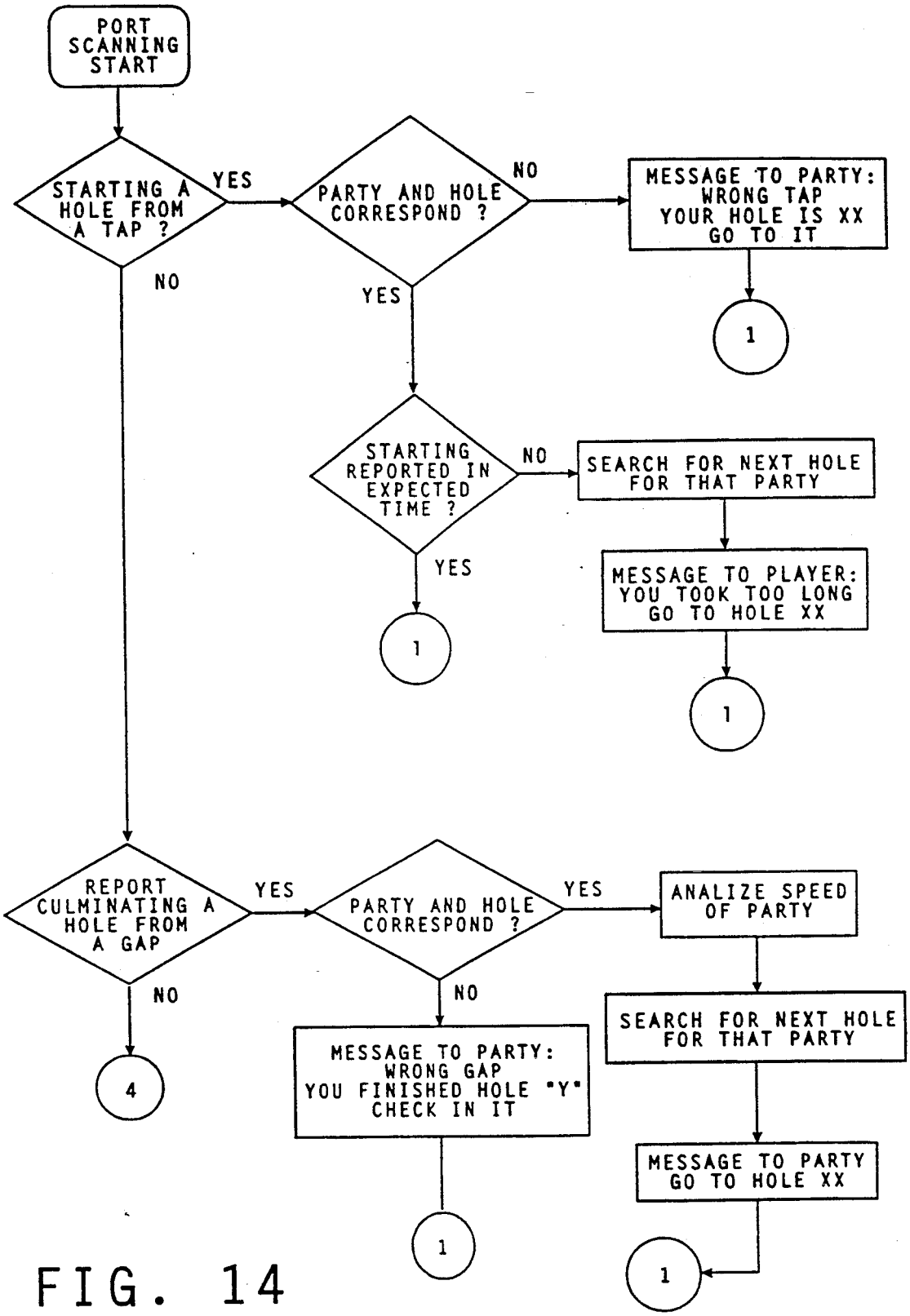
FIG. 14 is a further flow diagram for the system software program, following the flow diagram of FIG. 13.
Figure 15:
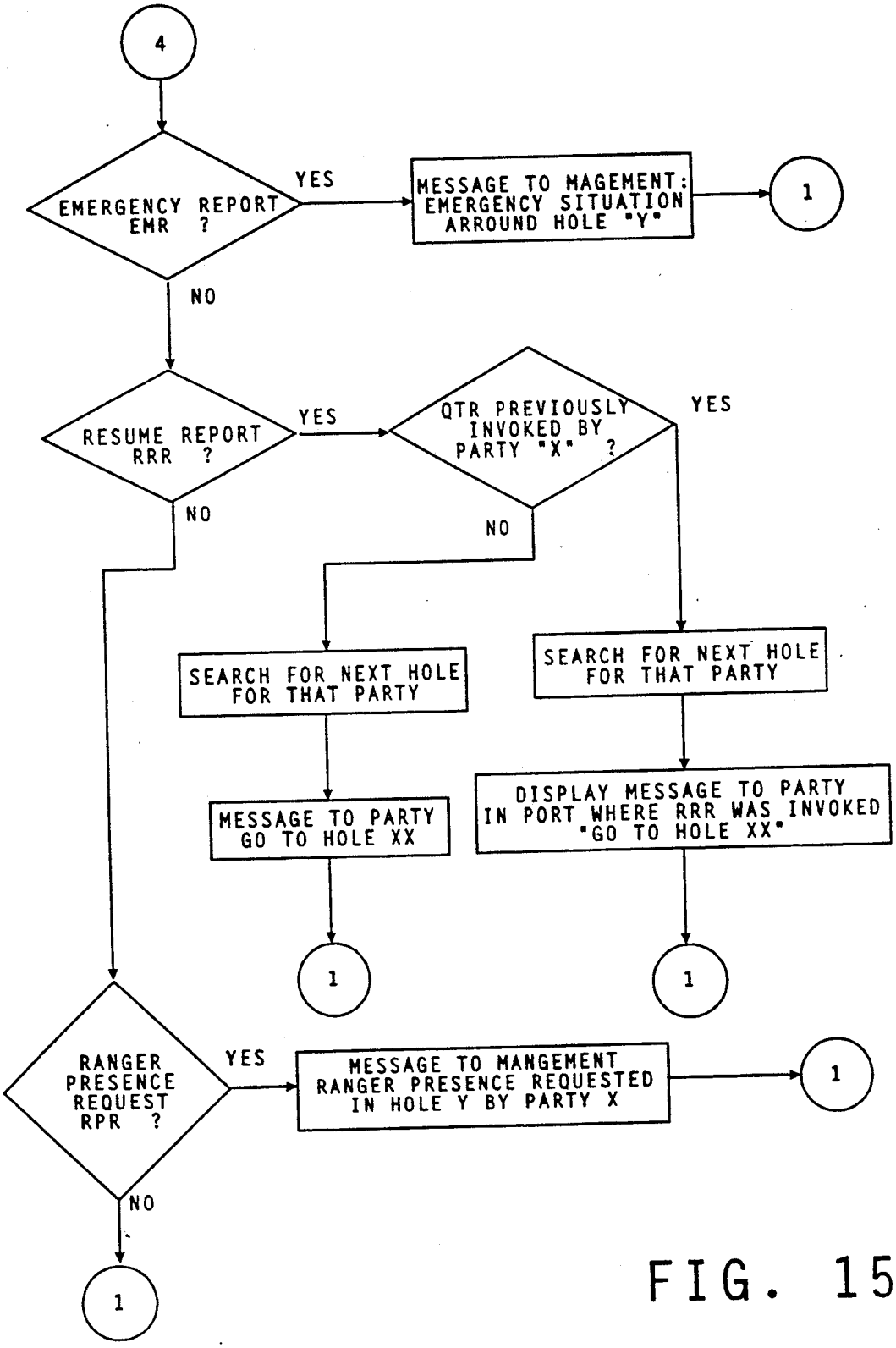
FIG. 15 is another flow diagram for the system software program, following the flow diagram of FIG. 14.
Figure 16:
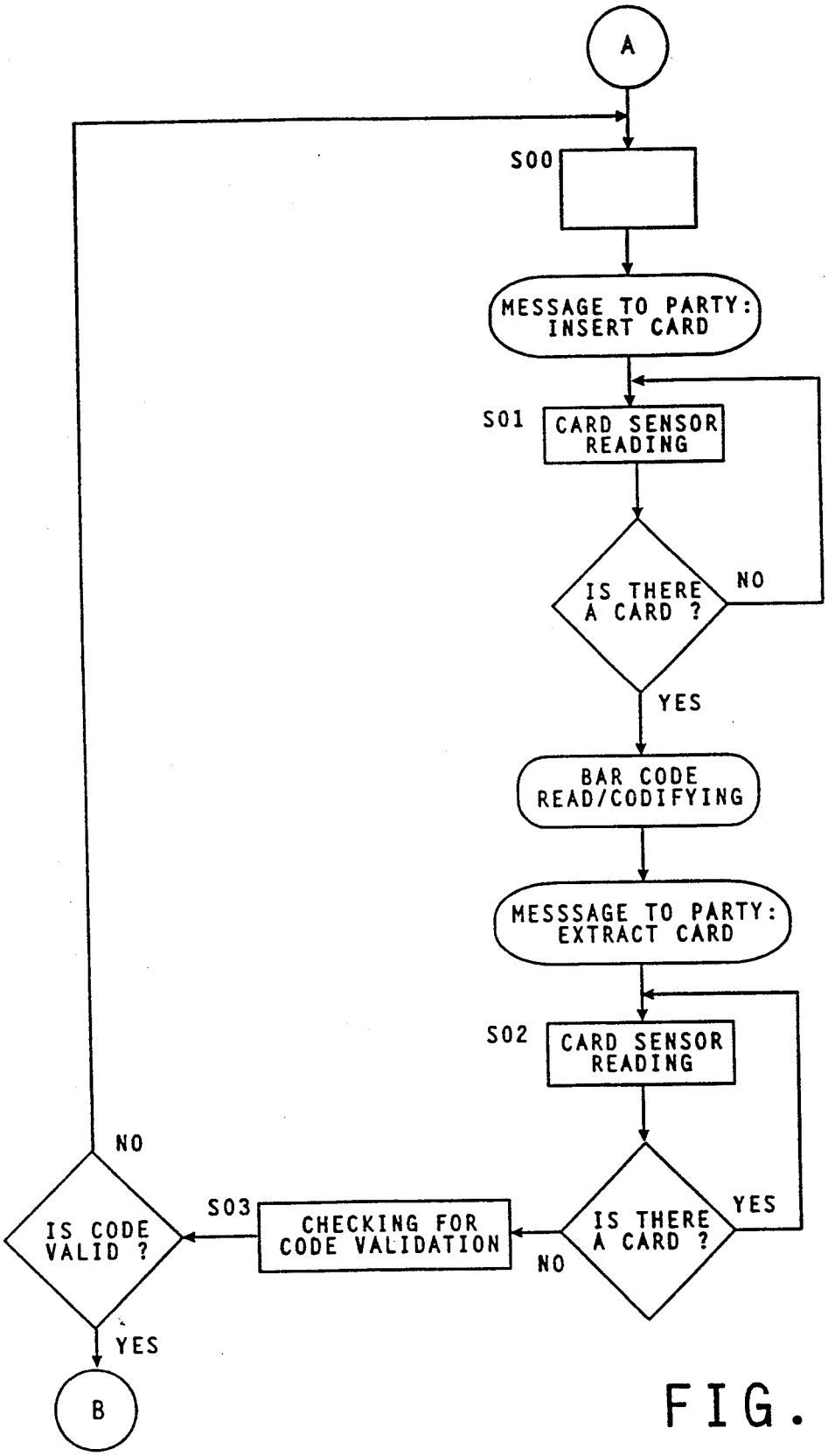
FIG. 16 is a f low diagram showing the algorithmic state machine of the tee area port, green area port and service area port programs.
Figure 17:
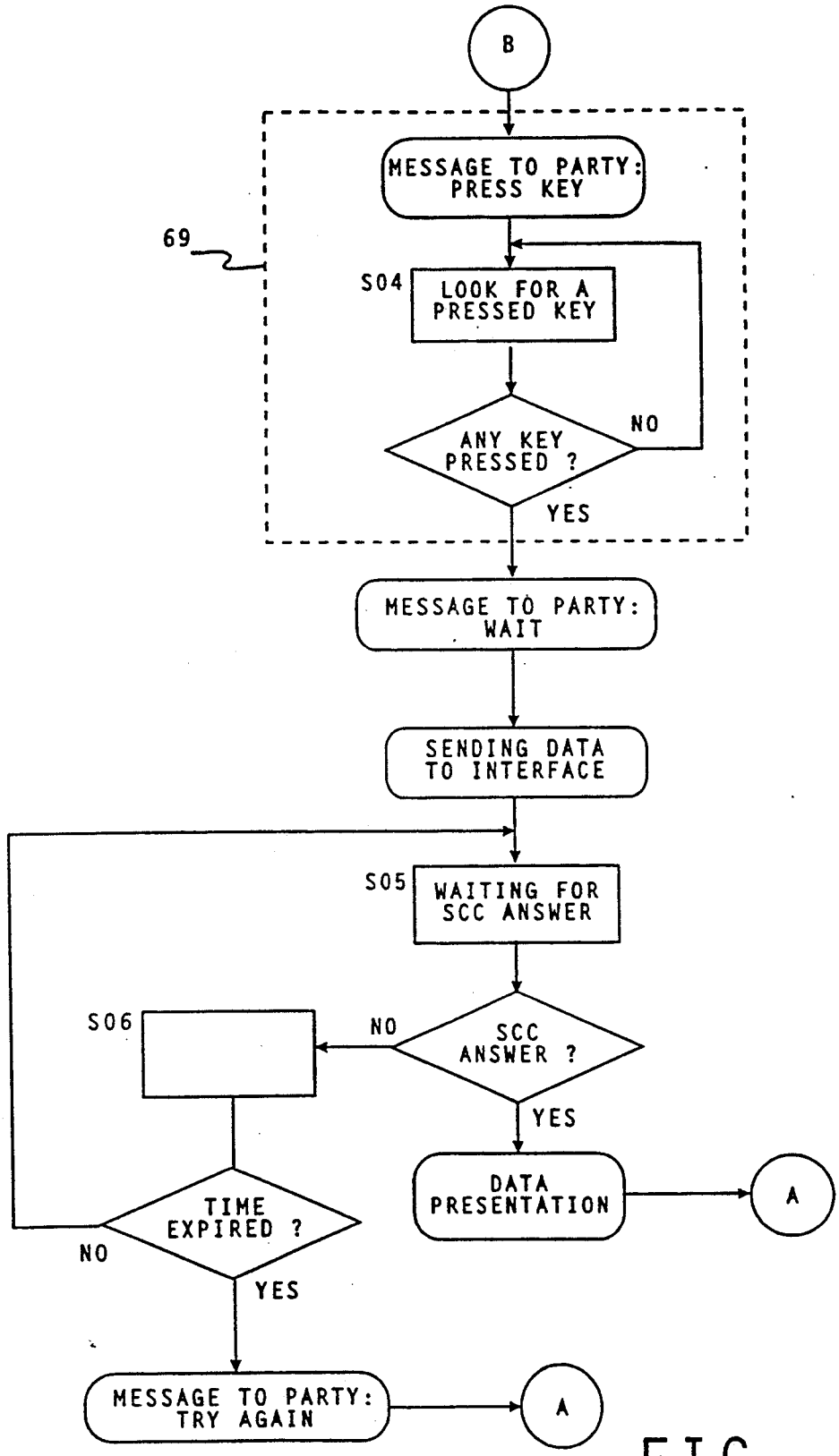
FIG. 17 is a f low diagram showing the algorithmic state machine of the tee area port, green area port and service area port programs, following the flow diagram of FIG. 16.

The elements of the system are as follows. The System Software Program (SSP) 16 is an expert system designed for each golf course according to its characteristics, the goals of the management, and the universally accepted rules of the game of golf. FIGS. 13, 14, and 15 illustrate the basic flow diagrams for the SSP.

Figure 4A:
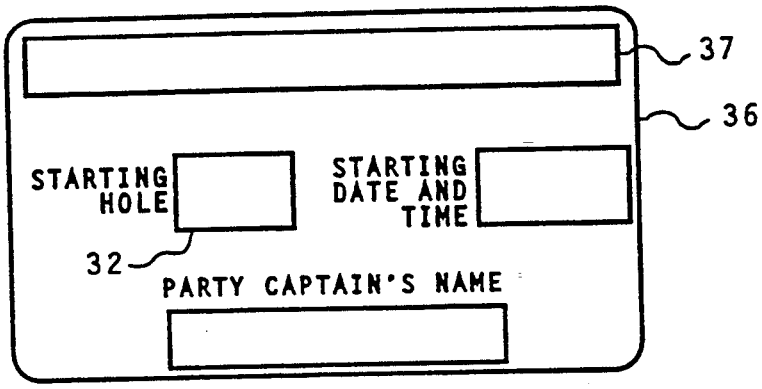
FIG. 4(*a*) is a plan view of a personal identification device.
Figure 4B:
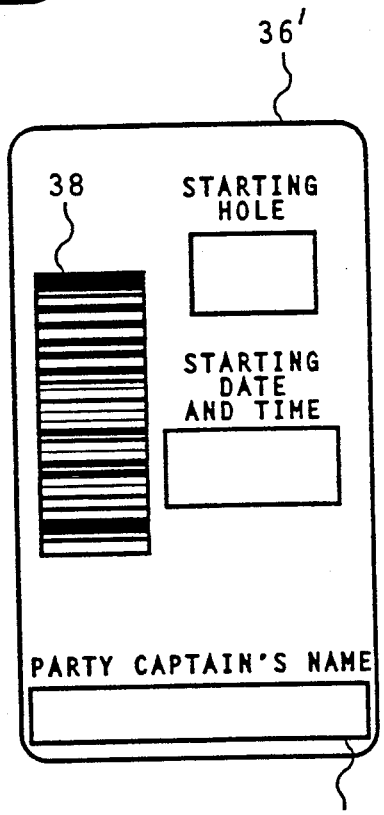
Figure 4C:
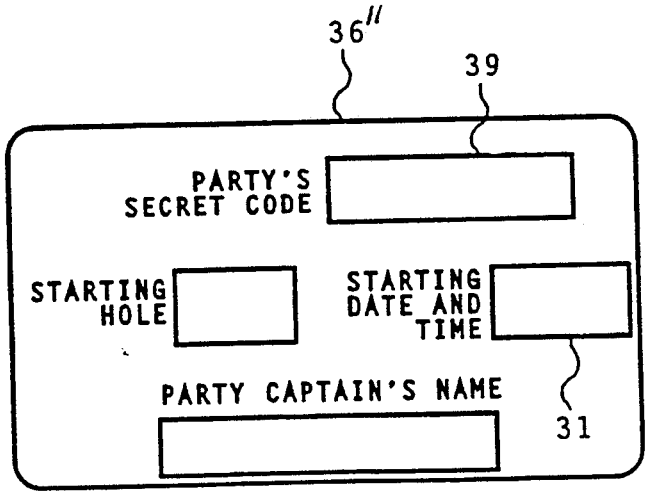

The Party Identification Device (PID) may, for a 9, be a card resembling a credit card, as shown in FIG. 4(*a*), 4(*b*) and 4(*c*). The PID 36', 36'' shown in these Figures is a mechanically, electromechanically, magnetically, or optically coded device that contains information about a specific party of golfers which is used to communicate with the system. A PID is conveniently placed in a shirt or pants pocket, is lightweight and compact and can be disposable.

In one different version of the system, the PID is replaced by a "secret code" personal identification number 39 which is only revealed to the members of the party. The PID is that which identifies a party, be it a physical element or not.

A Party Identification Maker (PIM) 48 is a machine or procedure that produces a PID, shown in FIG. 6.

A Tee Area Port (TAP) 11 is an electronic device permanently installed near the tees 17 of the holes, illustrated in FIG. 1. The function of a TAP 11 is to read the information on a PID 36, communicate with the system 16, display messages for the party on a small screen 42, and to send reports about the party to the system by means of buttons and keys 41 that are designated for different types of reports. The party presents the PID to the TAP at the beginning of a hole in order to inform the system that they are about to begin a hole.

Figure 5:
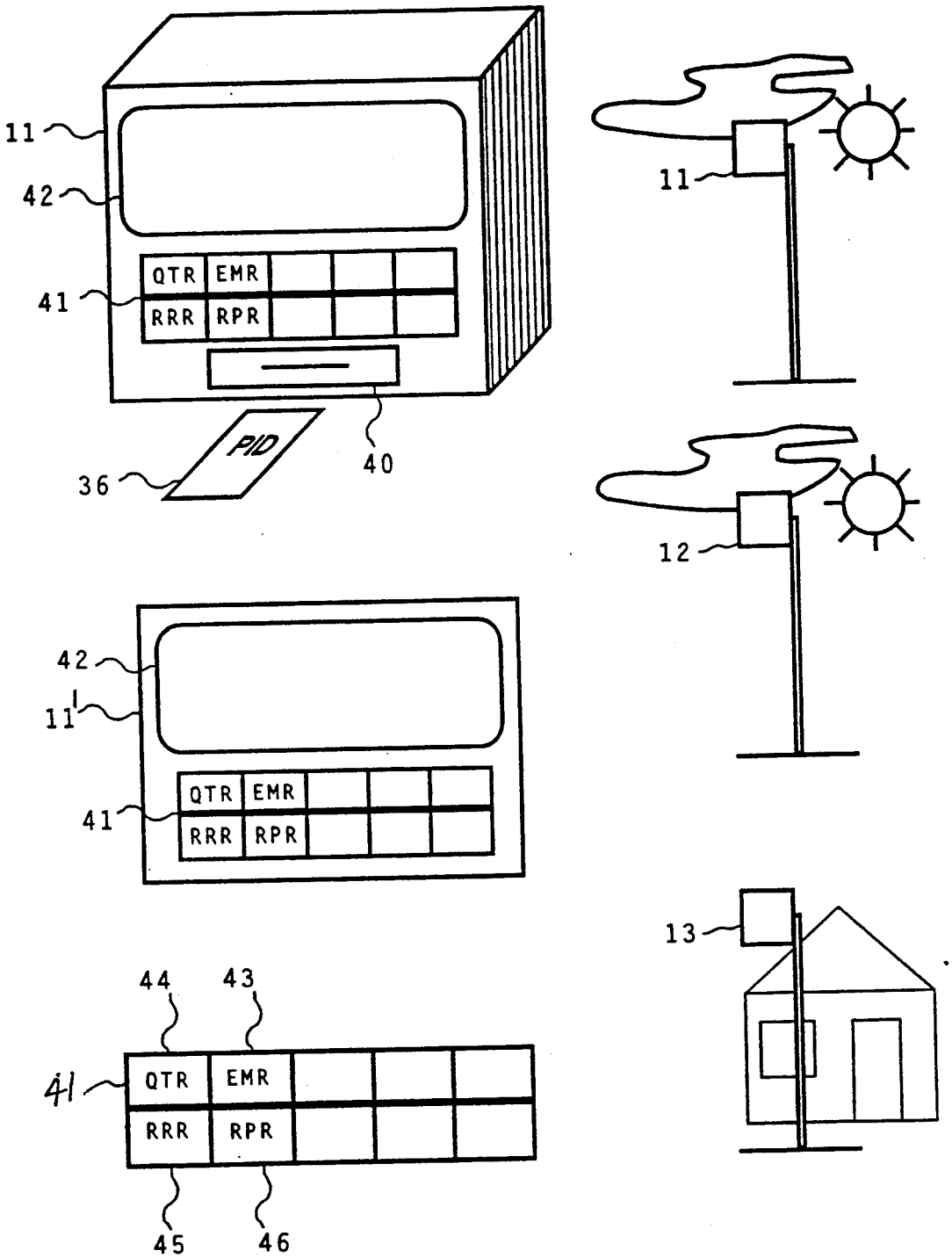
FIG. 5 is a schematic view of components of the tee area port, green area port, service area port and related monitors.

As shown in FIG. 5, TAP 11 is illustrated as a device with a slot in which to place a card 40, a small screen 42, and a set of buttons 4 1. The insertion and removal of the card without pressing any buttons informs the system that the party is about to begin a hole. For a card having a secret code, a TAP 11'without a slot for receiving a card may be used. Keyboard 41 may be used for either TAP 11 or TAP 11'.

A Green Area Port (GAP) 12 is a similar device to a TAP, but it is located near the putting greens 18. The party inserts the PID into the GAP to inform the system when they have finished the hole. The system, after receiving information from the party and having analyzed the playing situation on the golf course, sends to the GAP the information as to which hole the party should proceed. Insertion and removal of the card without pressing any buttons informs the system that the party has finished the hole.

A Service Area Port (SAP) 13 is a similar device to a GAP and a TAP, strategically installed in service areas 14 from where the parties may report the events that are described below.

An Emergency Report (EMR) 43 is a command that is available from any GAP, TAP, or SAP which permits a player, after having presented a PID, to report any emergency that arises on the golf course. The system immediately notifies the management of the situation so that appropriate measures can be taken.

A Quit Report (QTR) 43 is similar to an EMR. In order to be activated, a PID must be presented by a party wishing to suspend play before finishing the round. The system enters the suspension of play of that party.

A Resume Report (RRR) 45 is similar to an EMR and QTR. This report is used when the party wishes to resume the temporarily suspended play. Once the system receives a request to resume play, it indicates where the party may resume play taking note of the holes already completed by the party.

Ranger Presence Requirement (RPR) 46 is a command initiated by a party by presenting the PID. This command calls for the presence of a course official at a specific site.

The System Control Center (SCC) 16 is a group of electronic equipment located where the SSP is. The GAP, TAP and SAP supply data to the SCC for processing. The SCC includes the PIM 48 where the PID are produced.

The Communication Means (COM) 24 is the means by which the ports of the GAP, TAP and SAP are connected to the SCC. The communication may be by electrical cable, by fiber optic cable, or by radio waves.

As shown schematically in FIG. 6, the SCC communicates with management 49 to effect maintenance tasks 50, provide services, and send the management to those places on the course where their presence is required. In FIG. 6, the diagram shows the components of the system, other related equipment, and the connections therebetween.

The system described is sufficiently powerful to develop more sophisticated and advanced versions.

The method in which Intelligent Golf Matches Guidance system functions in practice is as follows. As soon as the players tell the person in charge of starting play that they are ready to begin playing, they are asked for the information needed, such as name 27, number of players 26, sex of the players 28, and their average score 29. If the players wish to play certain holes or a certain number of holes, they should inform the starter which holes they wish to play.

An important piece of information is the age of the players In order not to pester the players by asking them this information, this matter may be left to the starter's judgement. The players May be categorized as young, adult, middle-aged, or elderly, on a scale from 1 through 4, 1 being the youngest.

The starter enters the information in the system which, in turn, seeks the best starting hole for the players based on the information entered. The system arranges a logical sequence of play, not necessarily in numerical order, so that the golfers have few interruptions. Immediately afterwards, the PID 36 is given to the players. The PID indicates the hole from which the players will initially tee off. The golfers are given one or several identical copies of the PID.

The process of gathering data from the players and entering it into the system can be done in several ways. The players may report the information to the starter who will automatically enter it into the System Control Center. The players may also fill out a form with their personal information and give it to the Starter who will enter it into the SCC. Alternatively, the players may enter the data in multiple terminals that are available for this purpose.

On arrival at a designated hole, the players present their PID to the TAP, signaling that they will begin playing the hole. This information is received, stored and processed by the SCC. At this point the TAP may or may not display any relevant messages. After finishing the hole, the players present the PID to the GAP, indicating the end of the hole. The GAP sends this information to the SCC to be processed and immediately displays a message to the players indicating the hole to be played next. This process should be repeated at every hole. Presentation of the PID to the GAP, TAP, and SAP is a very simple procedure.

If the players try to play a different hole than the one to which they were assigned at any given time, the TAP at the unassigned hole will remind them of the assigned hole at which play should be continued. In the same way, if a group of players present the PID to an incorrect GAP, the GAP will indicate to them which hole they have just played and to which GAP the PID must be presented.

If the players decide to temporarily or permanently interrupt their game, without having finished all the holes, for example, in case of fatigue or rain, they should activate, prior to the presentation of the PID, the Quit Report 44, to inform the system of their decision. If necessary, it will revise the distribution of the different groups on the course.

If a group of players suspends their game temporarily and then decides to continue their game, they must activate the Resume Report 45 in any TAP, GAP, or SAP, and should wait for instructions from the system. The system has stored the holes played and determines which holes they should be played next. In such a situation, there may be a delay in reinitiating the game.

In case of an emergency on the course which could alter any of the different groups' play, a group should present a PID to the TAP, GAP, or SAP nearest to them to activate an Emergency Report 43. Immediately afterwards, the system informs the management in order for them to take the necessary measures. If it is convenient, The system will reorganize the groups on the course accordingly.

If a group of players that has been authorized to play at a speed slower than their capability, they may choose to play at a faster rate. This is accomplished by-activating a Resume Report 45 in the system. When the system receives a Resume Report from a group without having a prior Quit Report from that group, it automatically determines that the group wants to speed up the game. In a course which is not being utilized to its full extent, the management may choose to allow players to play at their own pace. When a group of players wishes to speed up play, or to pass another group, they request a Resume Report so that the system, in a logical, impersonal, and organized fashion, can decide their order of play at an increased speed.

If one or more parties wish to change their configuration, for example if a twosome and a foursome want to become two threesomes, the groups involved must request a Quit Report 44 and a Ranger Presence Requirement (RPR) 46 in order to request that the system send a representative of the management to inform him of their intent. This representative will in turn inform the system so that the necessary procedures be carried out for updating the information in the system, so that the players may be informed of where to proceed.

If any group of players modifies its configuration without informing the Starter, the system will not know of the change. If, for example, a twosome becomes a foursome, slowing down the speed of play, the system detects this delay and will alert the party that they must speed up play. If a group has been playing too slowly, without management's authorization, the system can request that the group speed up play or allow faster parties to play through by means of the TAP or GAP. If the group persists in playing at a slower speed, the system notifies the proper authorities to solve the problem according to rules established by the management.

Because of the complexity of the system, play may seem complicated. However, the system is completely invisible to the player. The player only perceives the smoothness of play on a course equipped with the system.

In further uses of the system, IGG can generate the scorecard for a party or group with the name and handicap of each of its players. This is very useful especially during tournament play where the players are grouped according to certain criteria such as handicap, sex, their standing in previous games, etc. This also applies to couples, doubles, scrambled, skins, and other types of tournaments where the distribution of the players within each group is determined by the organization of the tournament.

The GAPs and TAPS, may have some commands available to the players that allow them to request some services. For example, a request may be made to replace a cart that is running low on fuel or power, or otherwise malfunctioning, or to request the "bar" cart. The "bar" cart can be strategically placed on the course or mobilized from one customer to another, upon request, and according to the instructions of the system.

When IGG finds out that an event occurred like those described above, it knows that the person who ordered the service may be delayed in play.

The GAPs and TAPs can also be a means of communication between the Starter and the golfers by sending and receiving any message that is programmed into the system, for example, weather updates, notice that a certain part of the course is closed, a personal message to a certain player, etc.

A GAP and TAP may be automatically activated by the PID using sensors, optic sensors, or magnetic fields. This allows the party to play without inserting a card into the port. When the party wishes to make a report, other than having begun or finished a hole, the corresponding button on the port must be pressed.

In more advanced versions of the system which incorporate radio waves as the Communication Means 24 between the party and the SCC 16, all of the reporting may be initiated from transceivers 19 installed in the golf carts or in a player's golf bag. Such carts or golf bags are equipped with sensors that trigger the transceiver when they enter the tee off areas 21, putting greens 22, and service areas 23 so that the party may enter the appropriate information. The transceiver is comprised of a screen and a set of keys similar to those of the TAP, GAP, and SAP. The tee, green and service areas are equipped with devices that generate magnetic or electromagnetic fields each with its own identification code that are read by the sensors on the cart. The SCC then receives the information through the main antenna on the central transceiver.

In another embodiment of IGG, a secret code 39 is used instead of the PID. In this case, the party identifies itself at the TAP, GAP, and SAP by entering the personal code on a special set of keys on each port 41.

On courses where the distance between the ports and the SCC are relatively short, and where there is a common power source for the entire system, the power source may be used as the Communication Means COM. In this embodiment, a technique is used that allows the system's high frequency information to be transmitted by low frequency line current (e.g. 60Hz).

The IGG can serve as a database to store statistical information about the course which not only provides the management with a wealth of useful information to successfully manage the course, but also allows system to refine its program.

Since the system is able to work in many different technological surroundings, and with many options, the following illustration will describe the components of the system with reference to the figures.

In this illustration, the presentation from PID to TAP, GAP and SAP, is done manually; PID is a portable bar-code card; and COM is dedicated telephone cables used for each port.

The System Software Program (SSP) is the backbone of the system. It is a program which is able to make decisions and learn from its own experience. SSP is designed to be applied to any type of golf course. It is set up with information provided by the management and then it improves itself with its own experience.

The program is designed to designate the most convenient starting hole for a group of players on a specific golf course at a specific time. The program designates a starting hole from which a logical sequence can be followed for the continuation of the round of golf for each group of players. The program also evaluates the information obtained at each starting hole and takes into account many other sources of information, such as the characteristics of the course, the policies established by the management, the weather and other variables which may arise throughout the day. FIGS. 13, 14 and 15 illustrate the flow of information within the program.

The Party Identification Device (PID) is the key which links each party with the system by means of the TAP the GAP, and the SAP. Its function is that of supplying the most basic information pertinent to the party, such as identification number, time and date of the start, validation code, etc. The PID may be coded in many different ways offered by modern technology, but its function is always the same. The most likely options for storing the information will be magnetic cards or optical systems. The system may alternatively use a 'secret code', resembling a personal identification number (PIN). A PIN code could be entered by typing the code on a terminal at each port.

If a card with a magnetic strip is used, the magnetic strip may be offered on a thin plastic card 0.25 mm thick, or less, or it may be offered on a sturdy paper card. The size of the card is approximately the same as a credit card (86×54 mm).

In the example illustrated in FIG. 4(*a*), the information is printed on card 36 in the form of an encoded magnetic strip 37. Other relevant information, such as the date, starting time, and starting hole of that party, and the name of the designated party captain are included in the code. Another PID 361 is illustrated in FIG. 4(*b*) which shows a card having details of the party encoded into a bar code 38. A further PID, 36" shown in FIG. 4(*c*) has the party encoded as a PID or 'secret code' 39. Each of the cards shown in FIGS. 4(*a*), (*b*) and (*e*) also includes information as to the party captain's name 30, starting date and time 31, starting hole 32.

The Party identification maker (PIM) is a high-speed, high definition printer which may be used to print the blank PID cards. Any appropriate printer may be used, such as a dot-matrix, laser, inkjet or thermal printer. The printer preferably has a minimal resolution of 300 dots per inch. A PIM should also be able to print on thin plastic surfaces with similar output to a label printer.

If a 'secret code' system Is selected, the information may be written manually, without need for a printer.

A Tee Area Port (TAP) is an electronic device permanently located near every tee area. The device is used by the players to inform the system that they are starting to play that particular hole. The TAP also serves to send any reports or to receive any messages from the system. FIG. 5 shows a typical TAP keyboard on which a player may send an Emergency Report (Mm) 43, a Quit Report (QTR) 44, a Resume Report (RRR) 45, a Ranger Presence Requirement (RPR) 46 or other report or request.

Figure 11:
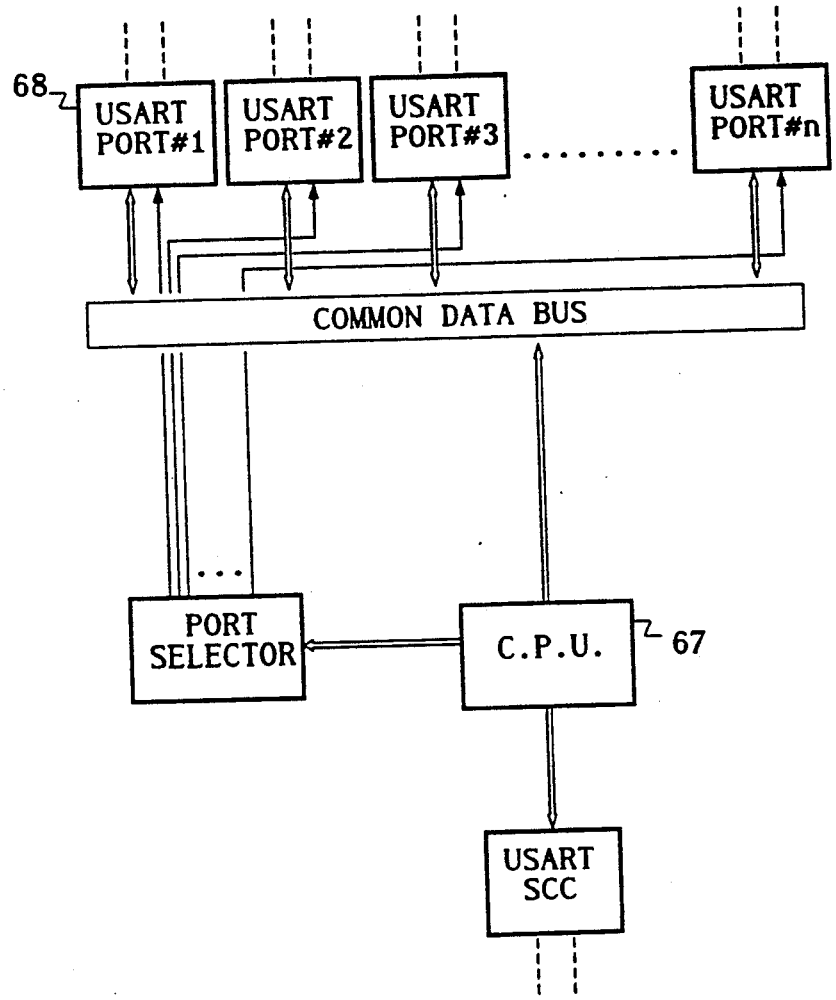
FIG. 11 is a port interface block diagram.
Figure 12:
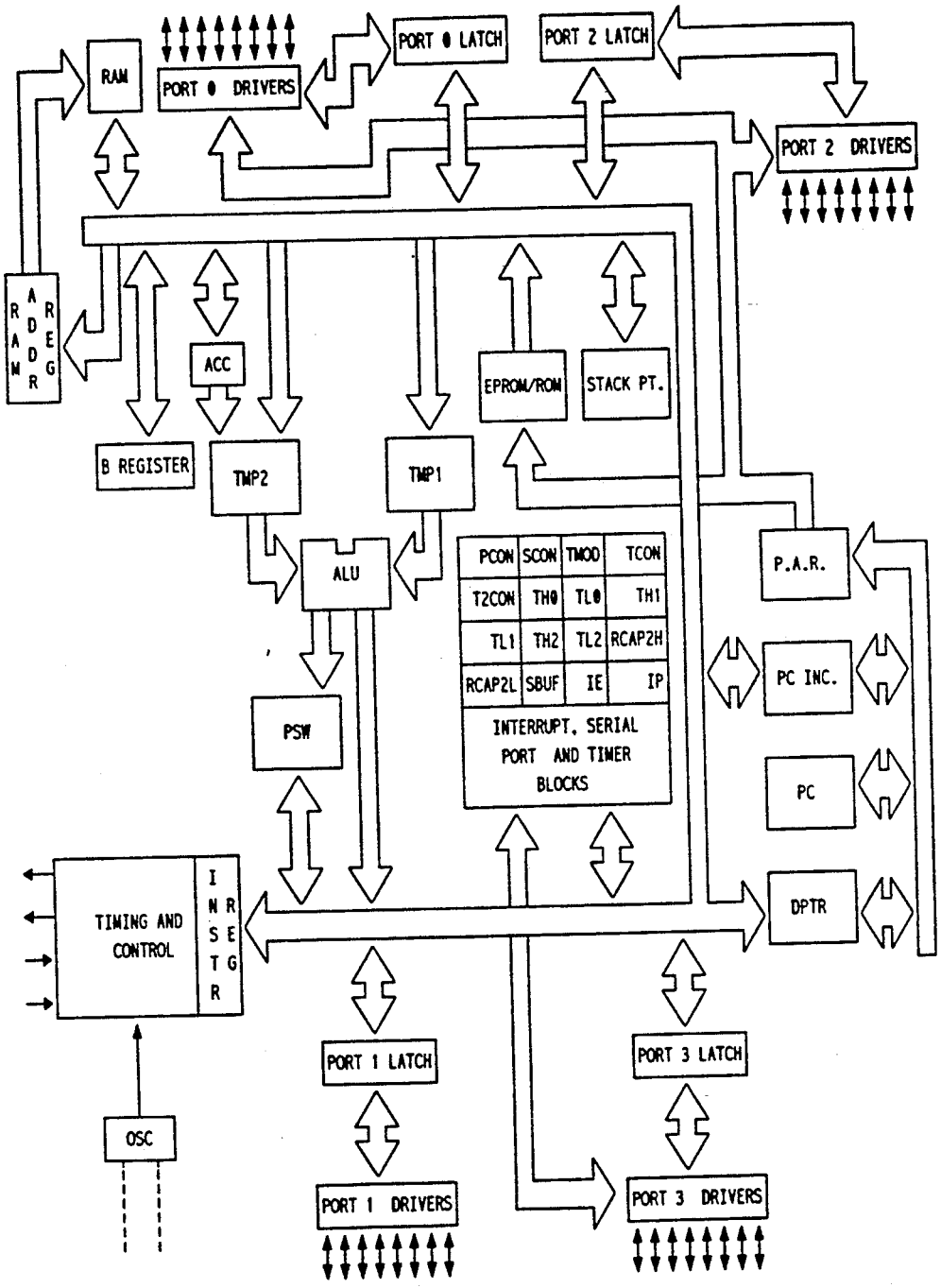
FIG. 12 is a block diagram for the central processing unit.

The communication system developed between the interface-SCC and the interface-ports depends on the communication system chose, which in this case is a "shielded, twisted pair" of telephone cables. Considering that the interface, shown in FIG. 11, is the link of information between the ports and the SCC, one of its objectives is that of organizing and transmitting data. The link between the ports and the interface is capable of storing and sending information, thereby resulting in an efficient communications system. At this point, the interface needs only enough intelligence to handle the transfer of information, there is little or no processing of data.

Figure 7:
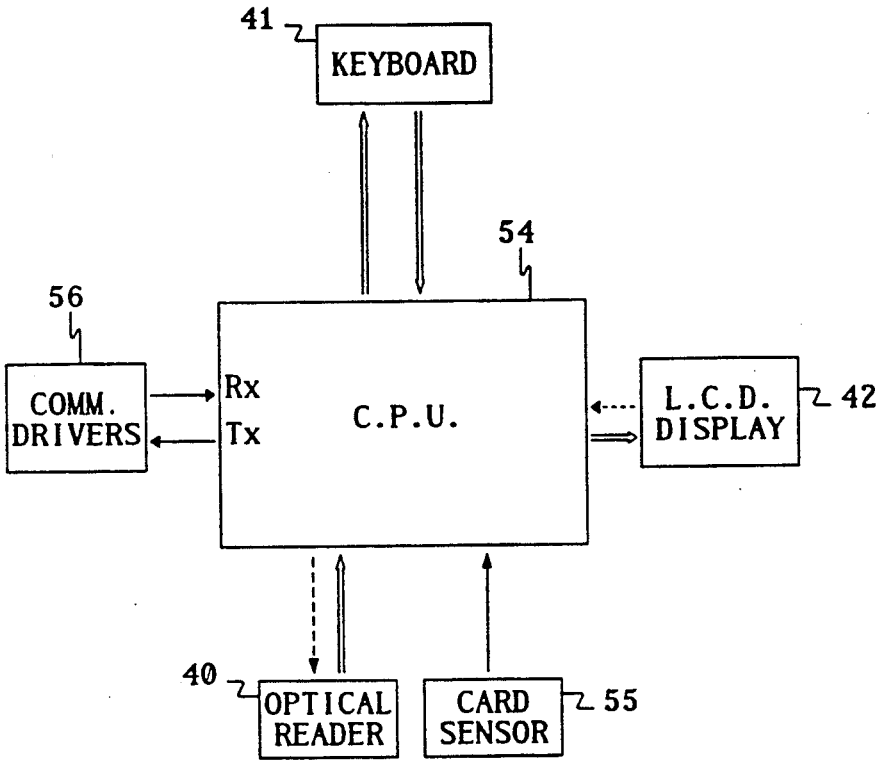
FIG. 7 is a block diagram of the tee area port, green area port and service area port.
Figure 8:
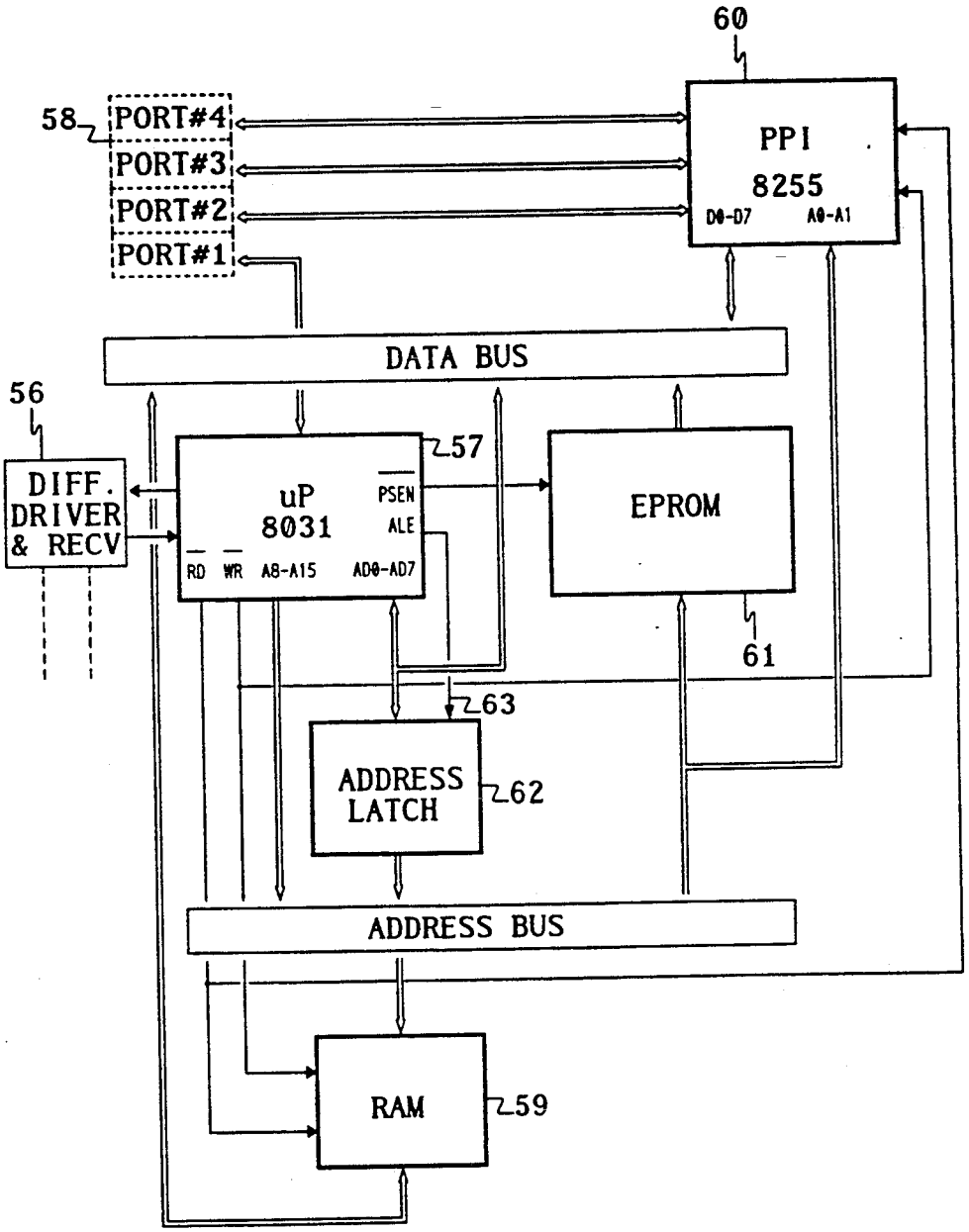
FIG. 8 is a block diagram showing the architecture of the TAP, CAP and SAP.

A typical Tee Area Port (TAP) is shown in FIG. 7. The TAP 54 includes an optical reader 40 of the fixed scanner type for use with a PID of the magnetic strip or bar code type, a keyboard 41 for interaction by the players with the system, including for entering a PIN when a 'secret code' PID is used; a small, backlit LCD display screen 42 by which the system may send messages or instructions to the players; an optical sensor 55 to verify the insertion of the PID (if a card-type PID is used); a central processing unit (CPU) 54; and a bilateral communication processor 56. FIG. 8 shows the architecture of the CPU which provides access to 4 ports 58 of 8 bytes each, all of which are biderectional to control the screen, the keyboard, and the optical sensor. A suitable CPU is made by INTEL (model 8031) of the type MCS-51. This model incorporates the ports directly, simplifying the architecture implemented in the unit. The programmable full duplex serial channel allows for direct control of the communications system.

The architecture of the system, shown in FIG. 8, includes an EPROM memory 61 which includes the monitor program of the TAP; an external RAM memory 59, which is in addition to the internal RAM microprocessor which stores temporary data; a programmable Peripheral Port Interface (PPI) which provides three separate input/output ports which are in addition to those on the CPU (Intel 8031); and an Address Latch 62 which is used to obtain the directional information in the internal "bus" data and address of the microcontroller. The ALE signal provides the synchronization for the determination of the presence of directional bits. The architecture shown in FIG. 8 has access to four bilateral ports 58, located on the devices previously mentioned (TAP, GAP, SAP). This assures the flexibility of future setups, even allowing for keyboard expansions.

The software of the TAP, GAP, and SAP complies with a structure that allows for future modifications or even the addition of new functions with very few changes. New functions may be added to the system to customize each port according to the functions desired without altering previously existing structures.

Figure 9:
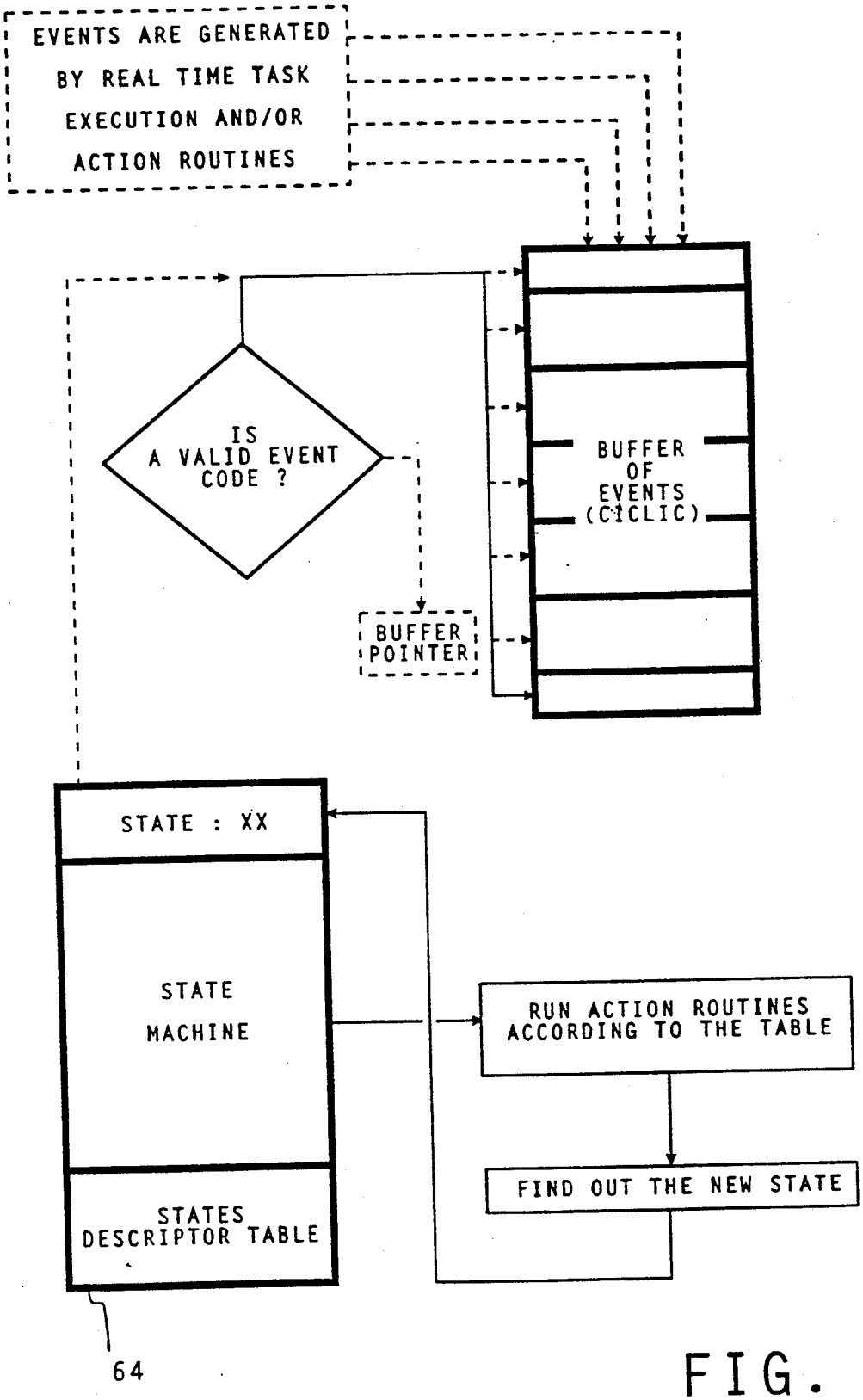
FIG. 9 is a flow diagram of the state machine functional scheme used for executing the software commands of the TAP, GAP and SAP.

FIG. 9 shows the State Machine Functional Scheme utilized to execute the software of the GAP, TAP and SAP which serves the States Table 64 according to the occurrence of predetermined events.

Figure 10:
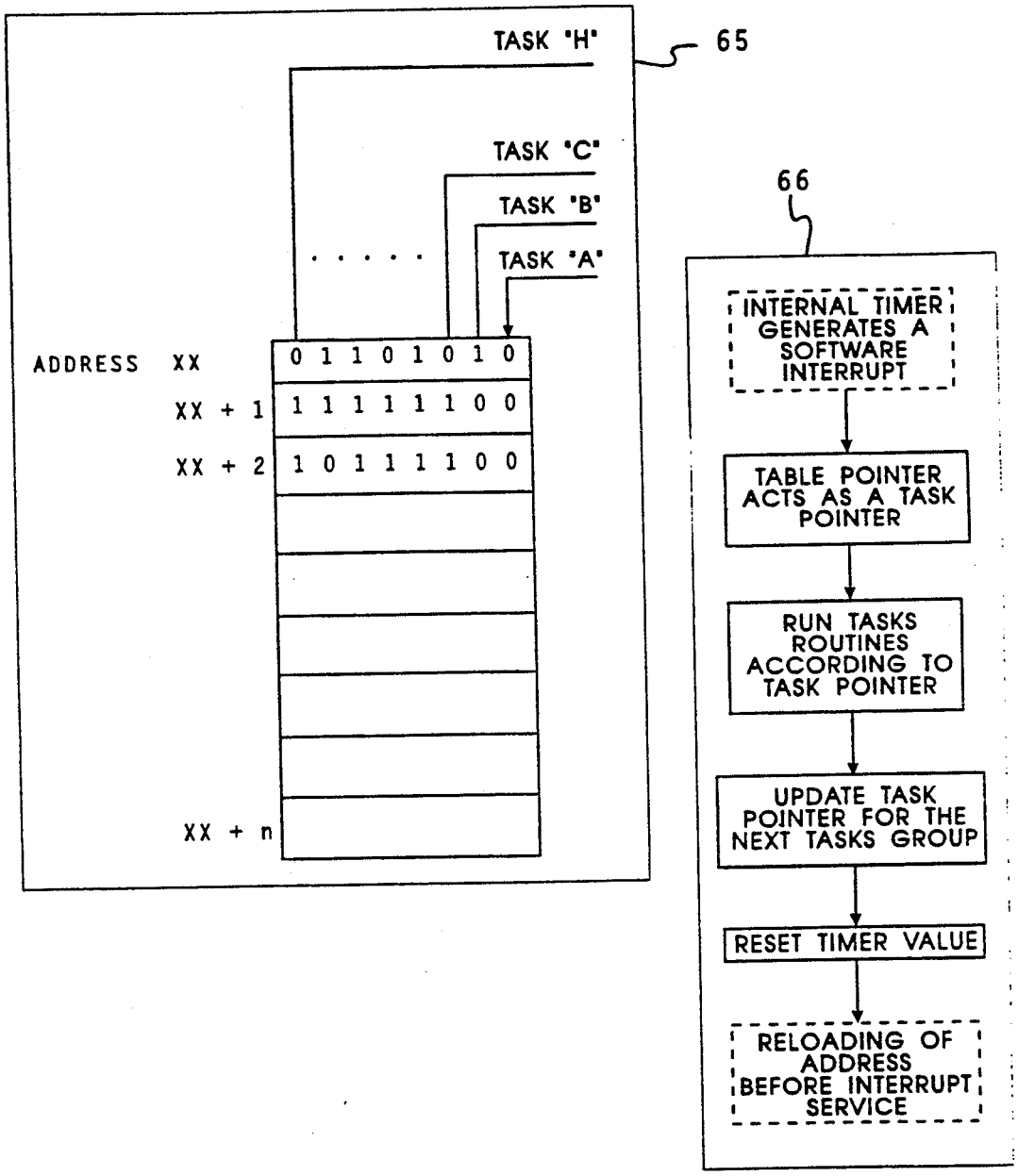
FIG. 10 is a flow diagram for a real time task execution table and real time task execution procedure.

FIG. 10 shows the Real Time Task Execution Table 65, and the Real Time Task Execution Procedure 66 present in the TAP, GAP and SAP software to execute certain functional routines of the Port; these routines differ from those of the SSP.

With respect to the hardware and software that interfaces with each port TAP, GAP, SAP/SCC, as shown in FIG. 11, the interface is fast enough to be able to efficiently handle the maximum number of ports that are established. The structure is similar to the structure of the port shown in FIG. 8. Universal Synchronous Asynchronous Receiver Transmitter devices (USART) 68 are used for transmitting and receiving messages from each port the interface processor 67 has the task of picking up and placing messages in the ports. The structure of the software monitor of the port interface PID, GAP, SAP/SCC is similar. Only the action commands and the tasks performed are different.

The TAP, GAP, and SAP are durable and can withstand inclement weather and daily wear by the user. The ports are hermetically sealed for protection from water and dust.

The screen of a port, as shown in FIG. 5, has a Liquid Crystal Display (LCD) 42 which displays alphanumeric characters. It is preferable that the screen be backlit to allow it to be read even under poor light conditions. The keyboard 41 is waterproof, resistant to abuse, and has a flat, plastic surface. It operates using the concept of a matrix.

A bar-code scanner or magnetic reader 40 is located in the port in such a way that allows movement of the PID by inserting the PID into the port in order to read the codified information. The bar-code or magnetic strip on the PID is located in such a way that there is a separation between the edge of the card and the bar code such that it lets the input optical sensor 55 detect the insertion of the card and be ready for reading the bar code.

Internally, the ports have a card with a printed circuit of the control with the circuit equivalent of the shown architecture and another card with the power supply in a linear fashion with surge control protection. The ports have 110 or 220 volt AC inputs and three DC outputs: +5 volts DC, +12 volts DC and −12 volts DC. Total output is 30 watts distributed in the following manner: 16 watts for the 5 volts DC output and 7 watts for each 12 volts DC output.

A Green Area Port (GAP) is identical to a TAP, but is coded so that the system can recognize it as being a specific GAP located in a specific green area.

A Service Area Port (SAP) is identical to a TAP, but is coded so that the system can recognize it as being a specific SAP located in a specific service area.

The System Control Center (SCC) located in the starter house is a computer dedicated for use with the IGG system. It is located in the management area for use by the starter for organizing the parties wishing to play on the golf course. The SCC may be a personal computer equipped with an interface that communicates with the TAPS, GAPs and SAPS.

An SCC should preferably have the following capabilities: a computer with an 80386 or 80486 or higher microprocessor, 33 or 50 MHz or faster speed and 4 to 8 MB RAM memory. Single or double floppy disk drives should be provided, with cache RAM, a 32 bit EISA SCSI controller, two parallel and two serial ports and a Super VGA graphics card with 1MB RAM.

For inputting data and sending messages, a keyboard of 101 or 124 keys is preferred. The keyboard is also necessary for generating reports and statistics and for entering general data and commands inherent in the system. A color monitor of about 16" is preferable for observing party data and viewing developments on the course as they occur. A hard disk drive of at least 100MB is needed to accommodate the structure of the program and to store the operational data of the system. Any printer capable of printing reports required by the management is sufficient.

A serial interface via a serial port so that the SCC can communicate with the TAPS, GAPS, and SAPs according to the protocol established by the SCC is also needed. The system further requires Uninterrupted Power Supply (UPS) used for the backup of the system including ports in case of power failure. A voltage regulator is included to prevent damages to the system and loss of programming and data in case of a blackout in the AC power line.

A mouse may be included and is recommended. Even though all the commands may be executed from the keyboard, the use of a mouse simplifies use of the system by the operator.

Optionally, a tape drive with online backup capability, or an additional hard disk drive for the mass storage of information may be used. The capacity of the storage is decided by the management.

The Communication Means (COM) is the means of communication and may include two dedicated, shielded telephone cables arranged as one pair of cables per port.

The use of other devices not described herein does not, in any way, diminish the Intelligent Golf Parties Guidance (IGG) system's objectives or fundamentals.

While the invention has been described with respect to certain embodiments thereof, variations and modifications may be made without departing from the spirit and scope of the invention.

What is claimed is:

1. A system for guiding a party of players around a golf course having a plurality of consecutively numbered holes each hole having a tee area port and a green area port associated therewith, said system comprising:

a system control center comprising means for transmitting information to and receiving information from a plurality of tee area ports and green area ports and means for designating a numbered hole to be played by a party and means for subsequently designating a next hole to be played by the party, said next hole bearing a number other than the next higher consecutive number compared with the number of the hole played;

said plurality of tee area ports comprising means for transmitting information to and receiving information from the system control center; and said plurality of green area ports comprising means for transmitting information to and receiving information from the system control center;

wherein the order of play of the holes is determined by the system control center in response to information identifying the party and at least one of the holes may be played out of consecutive number order of the holes.

2. A system according to claim 1 further comprising at least one service area port for transmitting information to and receiving information from the system control center.

3. A system according to claim 1 further comprising means for identification of a party for communicating with the system control center, the tee area ports and the green area ports.

4. A system according to claim 3 wherein the means for identification of the party comprises a magnetically encoded card and the tee area ports and green area ports each comprise a magnetic reader.

5. A system according to claim 3 wherein the means for identification of the party comprises a bar coded card and the tee area ports and green area ports each comprise an optical reader.

6. A system according to claim 3 wherein the means for identification of the party comprises a code including a plurality of alphanumeric symbols and the tee area ports and green area ports each comprise means for transmitting said code to said system control center.

7. A system according to claim 1 wherein each port comprises means for recognizing the identification of a party.

8. A system according to claim 7 wherein each port further comprises means for a recognized party to communicate with the system service center.

9. A system according to claim 8 wherein the communication means comprises a keyboard.

10. A system according to claim 1 wherein transmission and reception of information is carried out by telephone cable.

11. A system according to claim 1 wherein transmission and reception of information is carried out by fiber optic cable.

12. A system according to claim 1 wherein transmission and reception of information is carried out by radio waves.

13. A system according to claim 1 wherein transmission and reception of information is carried out by AC power line.

14. A system according to claim 12 wherein the ports are carried by the parties in the form of transceivers that are triggered when within a magnetic field or an electromagnetic field of a tee area, green area or service area.

15. A method for guiding a party of players around a golf course having a plurality of consecutively numbered holes, each hole having a tee area port and a green area port associated therewith, said method comprising:

(a) entering data concerning a party of players into a system control center;

(b) analyzing the data received with respect to the situation on the golf course, already inputted to the system control center;

(c) transmitting data to tee area ports and green area ports concerning a designated hole to be played by the party;

(d) monitoring play by the party on said hole according to input of information characterizing the party to the tee area ports and green area ports for receiving by the system control center;

(e) designating a next hole to be played by the party, following play of the hole designated in step (c), said next hole bearing a number other than the next higher consecutive number compared with the number of the hole played in step (c).

16. A method according to claim 15 further comprising providing at least one service area port in communication with the service control center and inputting information to service area ports for receiving by the system control center.

17. A method according to claim 15 comprising recognizing the identification of a party using a port.

18. A method according to claim 17 wherein the identification of a party is encoded in a magnetically encoded card and the method comprises reading the magnetically encoded card at tee area ports and green area ports each comprising a magnetic reader.

19. A method according to claim 17 wherein the identification of a party is encoded in a bar coded card and the method comprises reading the bar coded card at tee area ports and green area ports each comprising an optical reader.

20. A method according to claim 17 wherein the identification of a party is encoded as a plurality of alphanumeric symbols and the method comprises transmitting the code to tee area ports and green area ports.

21. A method according claim 17 wherein the identification of the party comprises a code and the method further comprises transmitting the code from a port to the system control center.

22. A method according to claim 17 further comprising communicating with the system service center by using a port.

23. A method according to claim 22 comprising communicating by using a keyboard of a port.

24. A method according to claim 13, wherein the ports are carried by a party in the form of transceivers, the method comprising triggering the transceivers when within a magnetic field or an electromagnetic field of a tee area, green area or service area.

25. Method according to claim 1 wherein transmitting and receiving information is carried out via telephone cable.

26. A method according to claim 15 wherein transmitting and receiving information is carried out by fiber optic cable.

27. A method according to claim 15 wherein transmitting and receiving information is carried out by radio waves.

28. A method according to claim 15 wherein transmitting and receiving information is carried out by AC power line.

* * * * *